US006497167B1

(12) United States Patent
Granger

(10) Patent No.: US 6,497,167 B1
(45) Date of Patent: Dec. 24, 2002

(54) WIPING MATERIAL DISPENSING DRUM IN DISPENSING APPARATUS WITH FORMAT AND LENGTH ADJUSTMENT OF THE DISPENSED MATERIAL

(76) Inventor: Maurice Granger, 17 rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/700,095

(22) PCT Filed: Apr. 6, 1999

(86) PCT No.: PCT/FR99/00783

§ 371 (c)(1),
(2), (4) Date: Nov. 8, 2000

(87) PCT Pub. No.: WO99/60906

PCT Pub. Date: Dec. 2, 1999

(30) Foreign Application Priority Data

May 25, 1998 (FR) ..... 98 06703

(51) Int. Cl.[7] ..... B32D 25/02
(52) U.S. Cl. ..... 83/337; 83/409; 83/649
(58) Field of Search ..... 83/649, 337, 338, 83/339, 650, 949, 409; 225/96

(56) References Cited

U.S. PATENT DOCUMENTS 4,137,805 A * 2/1979 DeLuca et al. ..... 226/110
4,404,880 A * 9/1983 DeLuca ..... 242/527.1
4,635,837 A * 1/1987 Granger ..... 225/106
4,712,461 A * 12/1987 Rasmussen ..... 225/106
5,048,386 A * 9/1991 DeLuca et al. ..... 225/106
5,131,302 A * 7/1992 Watanabe ..... 83/167
5,146,830 A * 9/1992 Granger ..... 83/337
5,441,189 A * 8/1995 Formon et al. ..... 225/106
5,937,718 A * 8/1999 Granger ..... 225/106
6,092,451 A * 7/2000 Granger ..... 83/335
6,145,423 A * 11/2000 Boreali et al. ..... 156/353
6,196,102 B1 * 3/2001 Granger ..... 83/335
6,224,010 B1 * 5/2001 Morand ..... 226/191
6,250,530 B1 * 6/2001 LaCount et al. ..... 83/650
6,412,655 B1 * 7/2002 Stuetzel et al. ..... 225/106
6,419,136 B2 * 7/2002 Formon et al. ..... 225/106

FOREIGN PATENT DOCUMENTS

EP 0526358 2/1993
FR 2746781 10/1997

* cited by examiner

*Primary Examiner*—M. Rachuba
*Assistant Examiner*—Jason Prone
(74) *Attorney, Agent, or Firm*—Wall Marjama & Bilinski

(57) ABSTRACT

A drum includes a hub defining in its central part a ring acting as a point for fixing and adjusting the cylindrical portion of the drum along variable positions by defining a variation in the material length strip format. The cylindrical portion of the drum is arranged in two parts capable of having a movement spacing one from the other by elastic deformation of one of the cylinder parts so as to define the drum circumference and the format variation, the parts capable of being mutually locked in position.

11 Claims, 6 Drawing Sheets

1
2
2a
3
9
B
23
16a6
18d
6
21
21a
16a1
22
18a
11g
10
17
20
11
17
16
17
16a2
11g
17
21b

WIPING MATERIAL DISPENSING DRUM IN DISPENSING APPARATUS WITH FORMAT AND LENGTH ADJUSTMENT OF THE DISPENSED MATERIAL

FIELD OF THE INVENTION

The invention relates to the technical field of apparatuses for dispensing paper wipes made of cellulose wadding, creped paper, or suchlike material, intended more particularly for wiping the hands of users, to the dispensing of toilet paper, and to the dispensing of paper towels. The pieces of paper may be in folded or unfolded form.

BACKGROUND OF THE INVENTION

The Applicant has developed many patents on these apparatuses of the above type in automatic and semiautomatic versions for dispensing strips of paper taken from a loading reel.

The Applicant has also developed, in French Patent No. 2,746,781, a drum for dispensing a wiping material in which a selector device allows the length of dispensed material to be varied.

The embodiment of the selector device in the above French patent, while technically interesting, is still complicated to produce and has a high manufacturing cost.

SUMMARY OF THE INVENTION

The intended object of the invention was therefore to devise a new drum for dispensing the wiping material that would allow the strip of material dispensed to be cut to varied lengths in a simplified and more reliable configuration.

In accordance with a first feature, the drum for dispensing a wiping material in a dispensing apparatus with adjustment of the format and length of the dispensed material, the apparatus being of the type comprising a housing (2), a cover (3), a drum (10), and a cutter device (5) built into the drum and arranged longitudinally in a slot formed in the latter, characterized in that the drum (10) comprises a hub (11) defining in its center an annulus **(11*e*) serving as the point of attachment and of adjustment of position of the cylinder part (16) of the drum, in variable positions defining a variation of the format of the strip in terms of the length of the material, and in that the cylinder part (16)** of the drum is made in two parts capable of being moved away from one another by elastic deformation of one of the parts of the cylinder in order to define the circumference of the drum and the variation of the format, the said parts being lockable in position with respect to one another.

These features and others also will become clear in the remainder of the description.

BRIEF DESCRIPTION OF THE DRAWINGS

In order to provide a clear idea of the subject of the invention, illustrated in a non-restrictive manner in the figures of the drawings in which.

Figure 1:
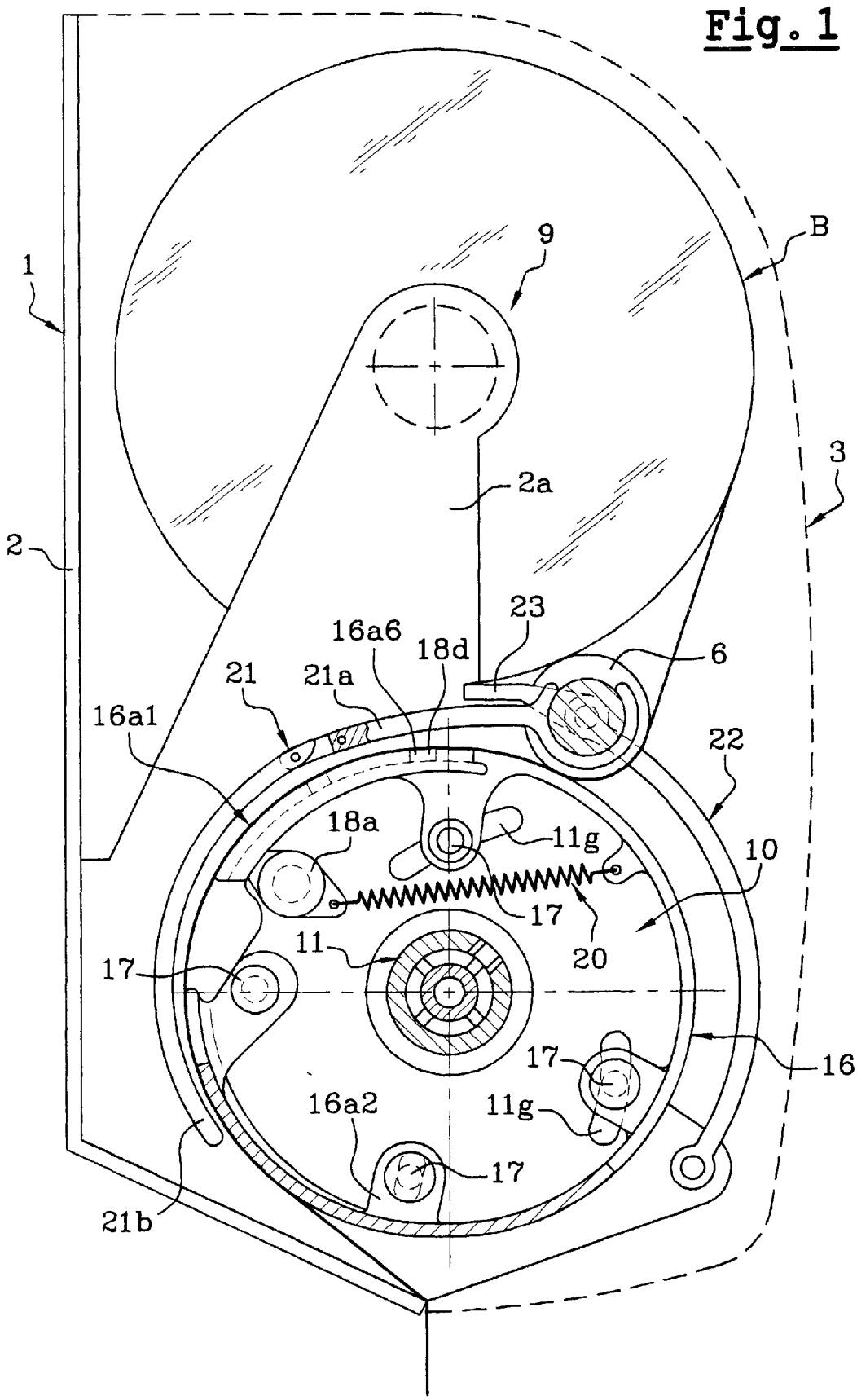
FIG. 1 is a side view of an apparatus for dispensing paper wipes taken on section A—A in FIG. 2.
Figure 2:
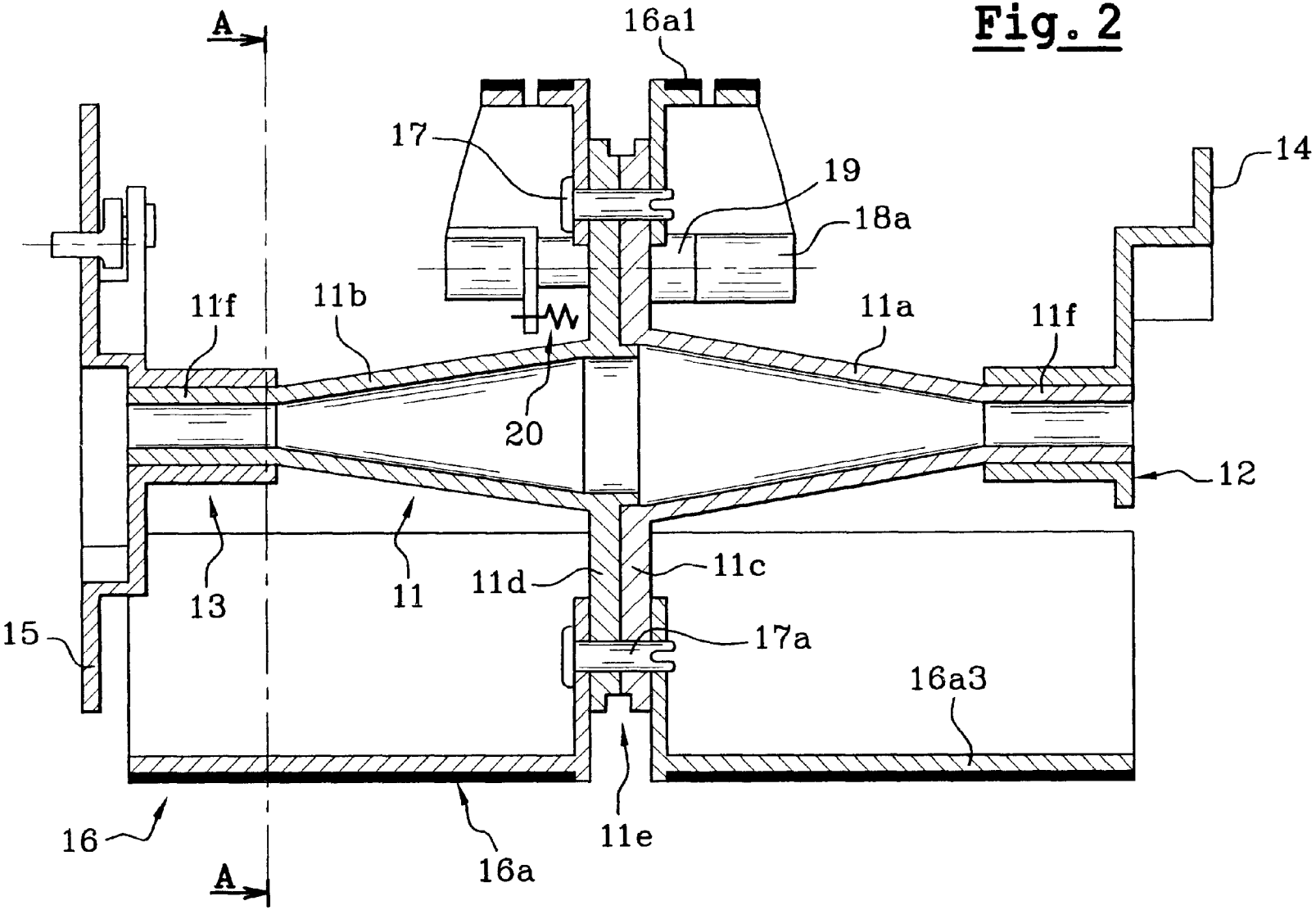
FIG. 2 is a sectional view of the drum taken alone illustrating the features of the invention.
Figure 3:
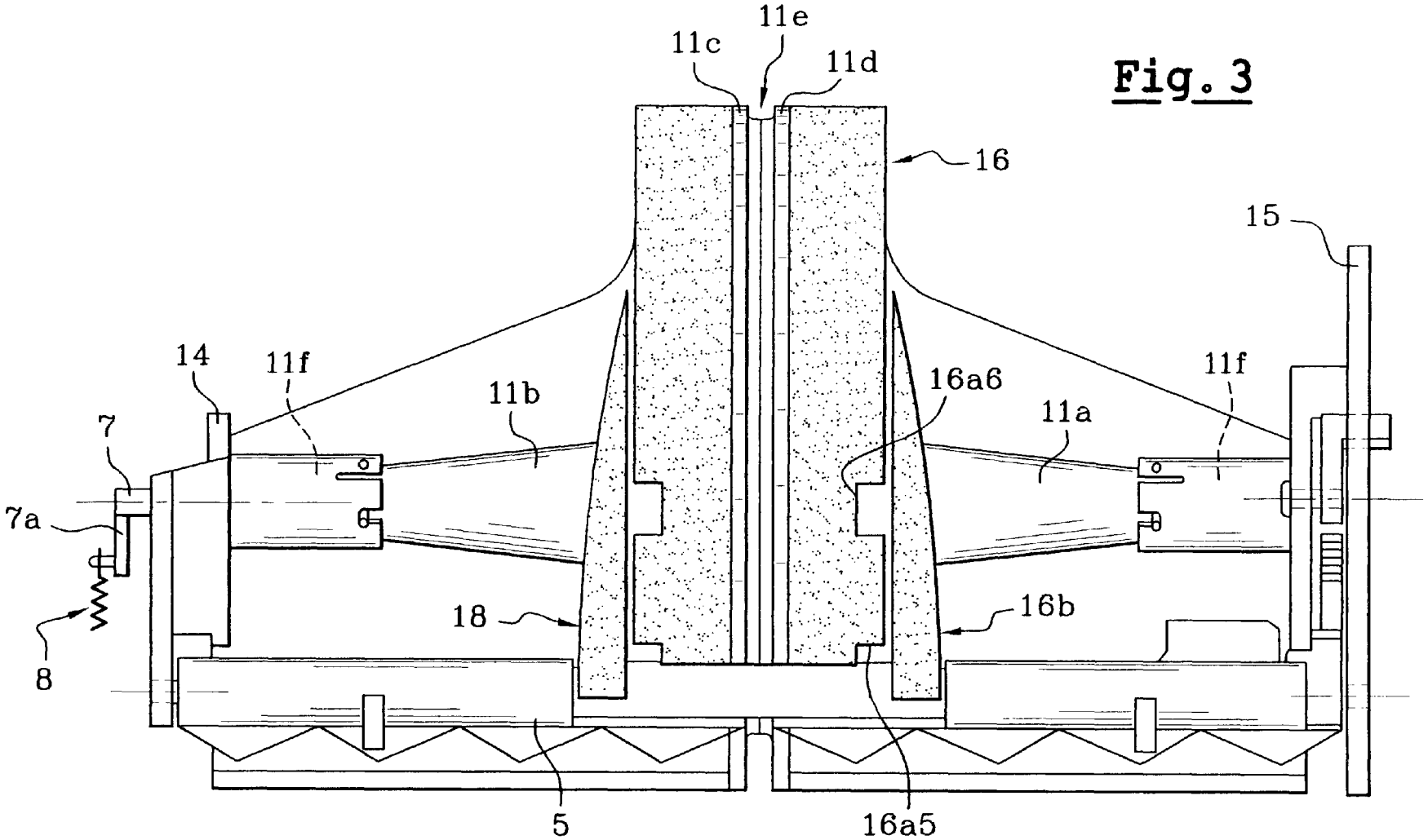
FIG. 3 is a front view of the drum in close-up in its position for selecting the smallest format.

In order to render the subject of the invention more concrete, it will now be described in a non-restrictive manner illustrated in the figures of the drawings.

DETAILED DESCRIPTION OF THE DRAWINGS

In order that the invention may be understood, an example of an apparatus for dispensing wiping materials in which the drum and its format-varying device can be used will be described first of all.

The apparatus is numbered as a whole by (1) and comprises a housing (2), a cover (3), a drum (10), a cutter device (5) built into the drum, and means for cocking and returning the drum that include a crank (7) and a spring (8). In its upper part, the housing (2) is fitted with side plates **(2*a*) capable of receiving the reel holder (9) of a reel of wiping material (B). In one embodiment, a presser component (6) may rest on the drum between which the paper from the reel passes. In a variant, the apparatus (1)** includes no presser components and the strip of paper from the reel rests directly on the drum when it is pulled in order to be cut.

According to the invention, the drum is depicted as a whole by (10). It comprises first of all a hub (11) made in two parts **(11*a*–11*b*) that each have at one end a disc plate (11*a*–11*d*) that are juxtaposed against each other to form an annulus (11*e*) that serves as the base for the support and attachment of a profiled piece capable of serving as the peripheral perimeter of the cylinder (16)** of the drum.

The other ends **(11*f*) of the parts (11*a*–11*b*) of the hub (11) can be engaged in and fixed to sleeve forms (12–13) fixed to end side plates (14–15) capable of receiving the cutter device (5)**.

The side plate (14) connected to the sleeve (12) possesses an axial elongation on which is constructed the crank (7) with a pin **(7*a*) for attachment of the drum return and cocking spring (8). The second side plate (15) is constructed so as to permit, in particular, attachment of the blade holder of the cutter device (5)**.

The cylinder part (16) of the drum (10), surrounding the hub (11), can be connected to the annulus **(11*e*) which is thus constructed in a special configuration such that, depending on its position, the circumference of the drum (10)** can be varied and therefore such that the length format of the strip of cut material can be varied.

According to the invention, the said cylinder (16) is in practice made in two parts capable of being moved away from one another in order to define the circumference of the drum and its variation.

More particularly, the cylinder (16) comprises two identical first parts arranged on either side of the annulus **(11*e*) of the hub (11) and comprises a sleeve (16*a*). Each of the latter comprises a ring part (16*a*1) situated around and adjacent to the annulus (11*e*), that is extended radially inward by lugs (16*a*2). The disc plates (11*c*–11*d*) defining the annulus (11*e*) of the hub (11) are also provided with curvilinear elongate slots (11*g*). The abovementioned lugs (16*a*2) are situated opposite the slots (11*g*), and connecting and fixing means (17) connect them together. These fixing means (17) comprise a pin (17*a*) that is capable of moving in the slots (11*g*) with the movements of separation of the first and second parts (16***a*), (16*b*) of the cylinder (16), as described in greater detail below.

Furthermore, the rings (16*a*1) having relatively narrow widths are constructed around an angle of approximately 150 to 180°. They are extended by a curvilinear supporting surface (16*a*3) defining a complementary support part of the cylinder (16) for the strip of pulled paper. This supporting surface (16*a*3) is of great length approximately as far as the end side plates (14), (15) of the drum (10) mounted on the hub (11). This supporting surface (16*a*3) is a half cylinder with slots (16*a*4), ending near the longitudinal region from which the cutter device (5) emerges from the drum (10). The slots (16*a*4) formed along part of the length of the supporting surface (16*a*3) provides a certain flexibility that enables the first part (16*a*) of the cylinder (16) to deform elastically.

In accordance with another provision, the ring (16*a*1) of the first part (16*a*) of the cylinder (16) is provided near its free end with a plurality of recesses (16*a*5–16*a*6) formed partly at the end and partly along its outer peripheral edge, the purpose of which will appear later.

As a result of its configuration, the first part (16*a*) of the cylinder (16) is capable of some degree of elastic deformation by expansion and extension particularly in the region of the ring (16*a*1) constructed as above.

The second part (16*b*) of the cylinder (16), capable of acting in combination with the first part (16*a*) and producing the desired effect and function of varying the format to which the paper is to be cut, will now be described.

This second cylinder part (16*b*) is constructed in the form of plates (18) hinged to the annulus (11*e*) of the hub (11). The annulus (11*e*) has, on either side of its plane, cylindrical projecting supports (19) on which rings (18*a*) connected to each plate (18) are mounted. These plates (18) can come into contact underneath and partially on the ring part (16*a*1) of the first part (16*a*) of the cylinder (16). Each plate (18) has a curvilinear profile with an inner region (18*b*) straddling the abovementioned ring part (16*a*1) and an adjacent raised region (18*c*) that can be in the same plane as the part of the cylinder (16) in the rest condition.

It should be explained that the raised region (18*c*) and the outer surface of the ring (16*a*1) of the first cylinder part (16*a*) are each provided with a rough surface to enhance the contact and pulling of the strip of pulled paper.

Also, the inner region (18*b*) of each plate (18) is given a projection (18*d*) whose profile and form correspond to the recesses (16*a*5–16*a*6) formed in the ring part of the first cylinder part (16*a*). It should be explained that at least one return spring (20) is attached by one end (20*a*) by an inwardly projecting lug 27 formed on the ring of the first cylinder part (16*a*), its other end (20*b*) being attached to a corresponding ring (18*a*) of the plate (18).

The operation of the drum (10) and in particular, the design of the cylinder whereby the format of the strip of paper to be dispensed can be altered will now be explained.

In the normal position, the cylinder (16) is in the form of a circle. The plate (18) is in contact with the inside surface of the ring (16*a*1) of the first cylinder part (16*a*), while the spring (20) is relaxed. The free end of the ring (16*a*1) of the first cylinder part (16*a*) is roughly adjacent to the cutter device (5).

When the operator wishes to increase the length of the format of paper dispensed, he or she must open the drum (10), that is to say move the first cylinder part (16*a*) away from the second cylinder part (16*b*) in order to give the drum (10) a non-circular configuration. With regard to this, the operator, by a simple manipulation, can grasp the central annulus (11*e*) or the ring (16*a*1) of the first cylinder part (16*a*) and move it away from the stationary part defined by the second cylinder part (16*b*), bringing about a displacement of the connecting pins in the slots formed for this purpose. The amplitude of the adjustment depends on the format chosen. The projecting form provided on the plate enters the indentations or recesses formed on the ring (16*a*1) of the first cylinder part (16*a*), thereby locking it in position. When the first cylinder part (16*a*) is opened to its greatest extent, the return spring (20) is kept at its greatest displacement and tension for the greatest opening of the annulus (11*e*) of the cylinder (16). The slots that have been formed in the cylindrical supporting surface of the first cylinder part (16*a*) are able to absorb the deformation of the cylinder (16) as it is opened to suit the predetermined format.

Figure 4:
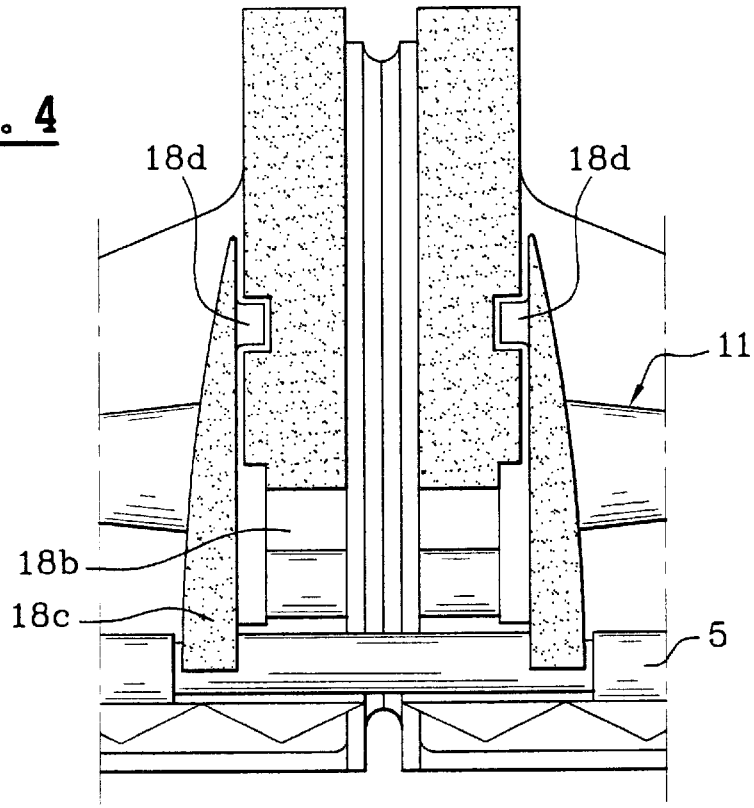
FIGS. 4 and 5 are partial views similar to FIG. 3 showing the selector device in the middle and largest positions of variation of the format.
Figure 5:
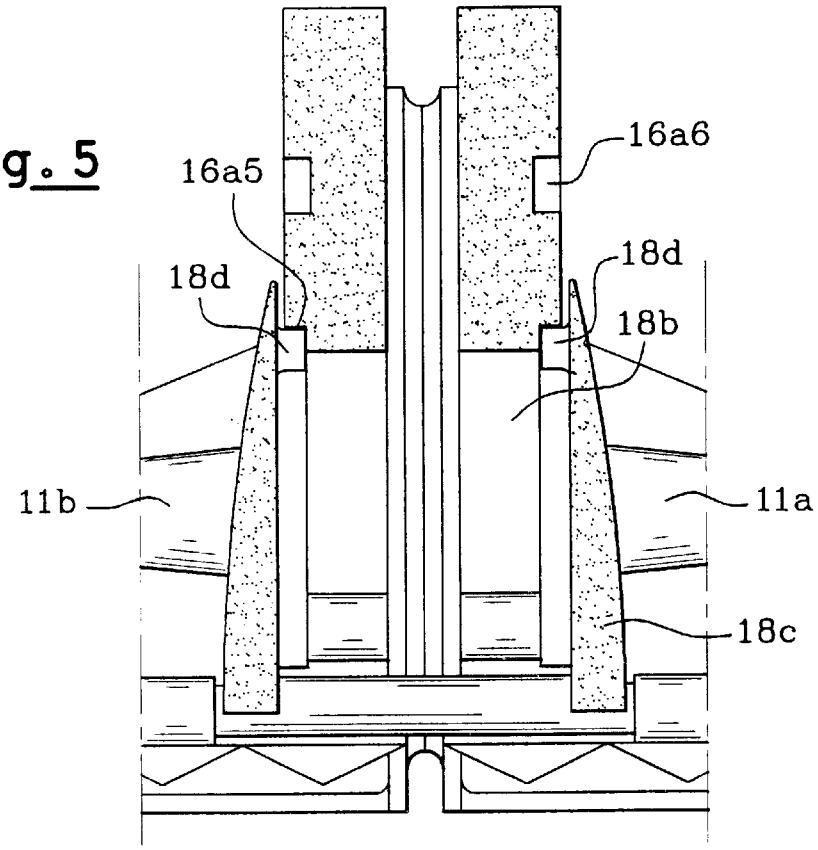
Figure 6:
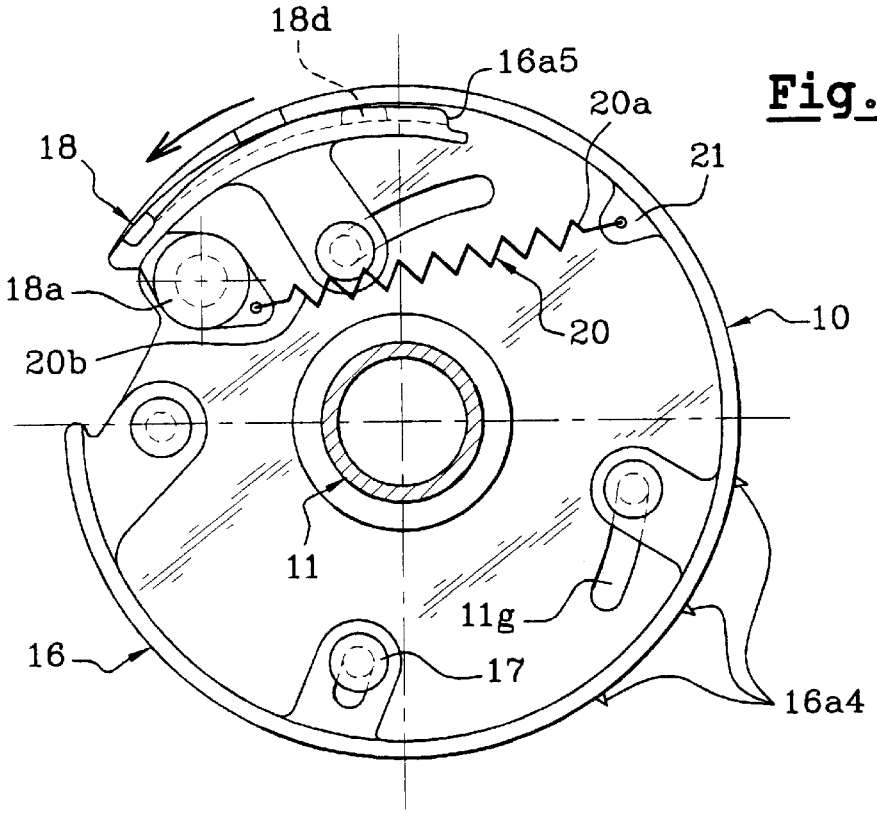
FIGS. 6 and 7 are views taken on section A—A in FIG. 2 illustrating the position of the components of the drums in the periods of dispensing strips of material, in the smallest format and in the largest format.
Figure 7:
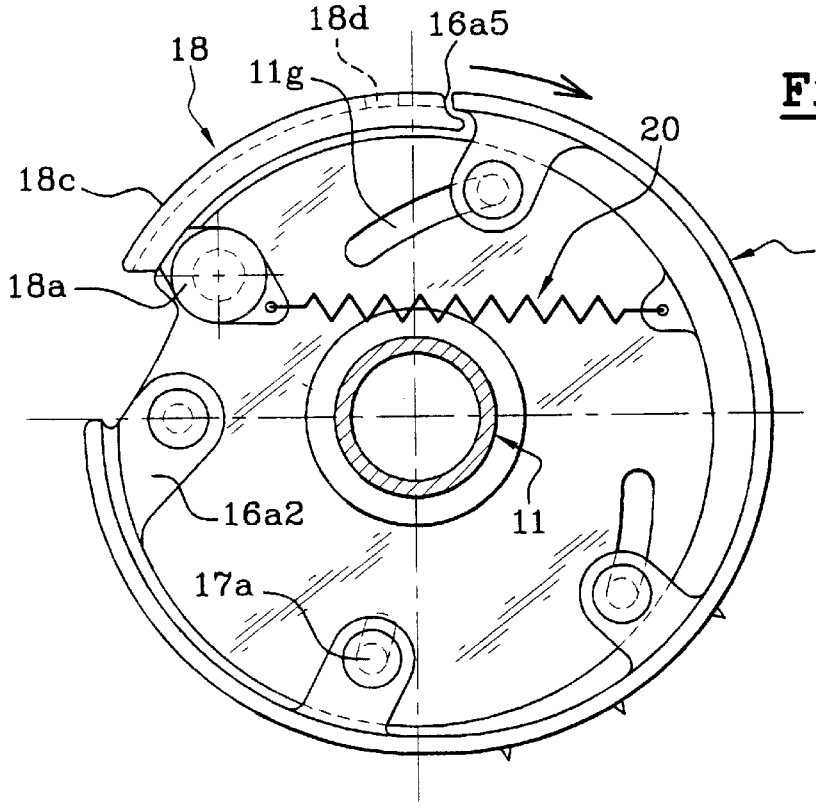

Resetting, corresponding to the smallest format of the strip of pulled material, and of the circular configuration of the drum (10), requires that the plate (18) be pressed into the drum by pivoting into the drum (10). This frees the complementary projection/indentation locking region(s) formed on the plate (18) and on the ring (16*a*1) of the first cylinder part (16*a*). The relaxation of the return spring (20) brings the first cylinder part (16*a*) back to its initial position shown in FIG. 4 of the drawings.

According to the invention, the number of possible formats of the strip of paper to be cut is a function of the number of indentations formed on the ring part (16*a*1) of the first cylinder part (16*a*).

Resetting, corresponding to the smallest format, is carried out by the simple process of pushing the plate (18) in. The drum described above can be used on different types of paper material.

As an adjunct to the main means of the invention, a dispensing apparatus of the abovementioned type containing the variable-format drum, comprises a paper guide (21) formed in two hinged parts (21*a*–21*b*) and attached by one of these parts (21*a*) by clipping it around the central part of the presser component (6), if the latter is present in the apparatus.

Also, the guard (22) for protecting the cutter blade is attached between the side plates of the housing and is likewise mounted in such a way as to be capable of elastic pivoting by means of a hinge pin (22*b*) to cope with the rotation of the drum when differing formats are being cut.

Figure 8:
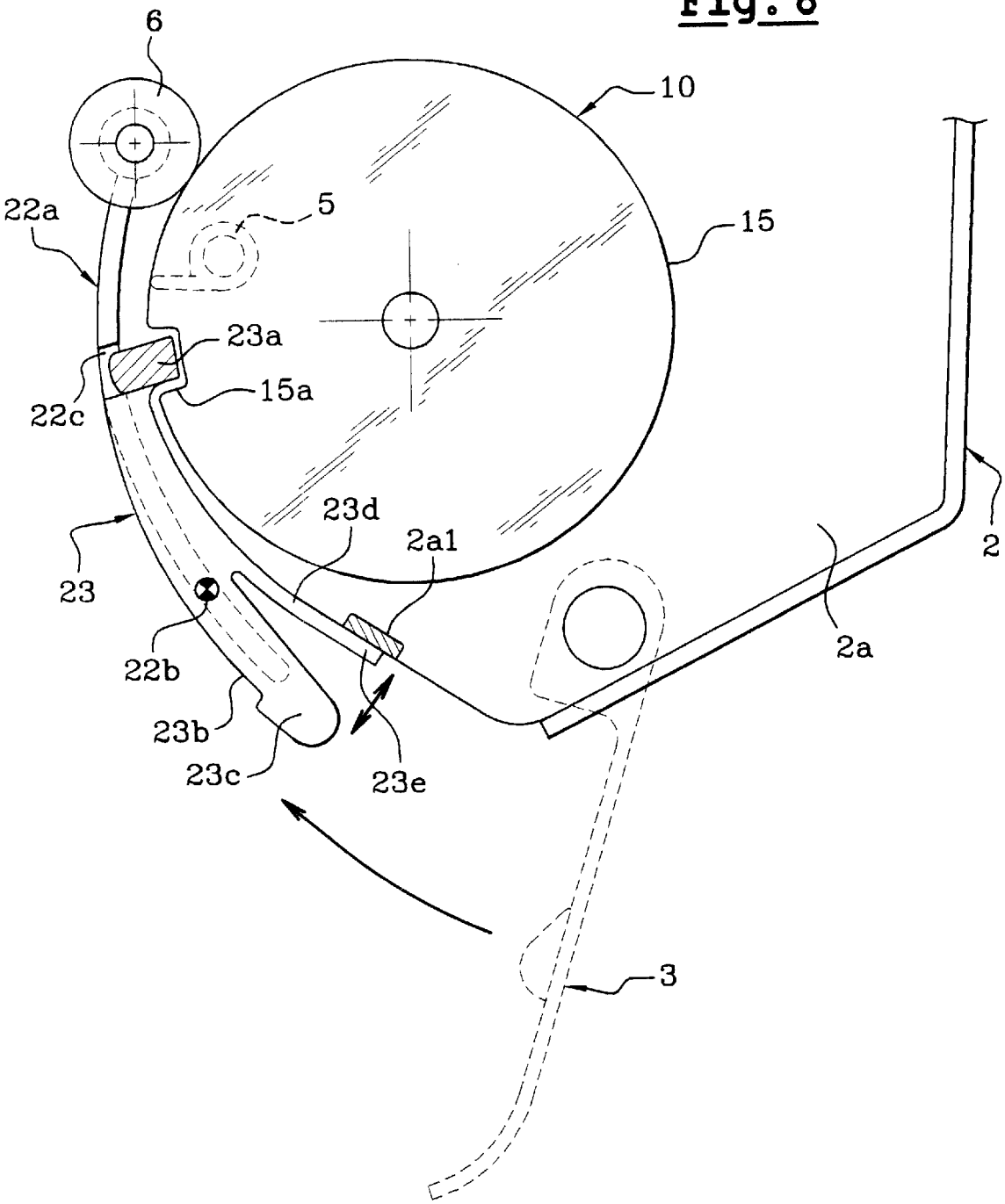
FIG. 8 is a schematic and partial side view illustrating a lock for immobilizing the drum when the cover is opened.

With reference to FIG. 8 of the drawings, it is possible to add a lock (23) with whih to immobilize the drum (10) when the cover (3) is opened, either to load the apparatus or to modify the format of the strip to be cut.

This lock (23) takes the form of a curved bar inserted between one of the side plates (2*a*) of the housing (2) and the opposing face (22*a*) of the protective guard (22). This bar is advantageously hinged about the hinge pin (22*b*) of the guard (22). The bar (23) is provided at its upper end with a form (23*a*) which projects inwardly and fits into a recess (22*c*) formed for this purpose in the guard. The lower end (23*b*) of the bar includes a projecting form (23*c*) protruding forwards towards the cover (3). The bar also includes a tongue (23*d*) capable of elastic deformation, whose end (23*e*) can be placed against and rested on a stop piece (2*a*1) formed on the side plate (2*a*). During normal operation of the apparatus with the cover (3) closed, the latter presses against the enlargement on the end of the bar so that it pivots and in particular on its upper end, freeing the drum (10) to rotate by the disengagement of the upper projection (23*a*) with a notch (15*a*) formed in the side plate (15) of the drum (10).

When the cover is opened it no longer comes into contact with the projecting lower end (23*c*), removing the elastic pivoting action of the bar. The bar pivots and due to the elastic returning action of its tongue part, allow the projecting form (23*a*) to drop into the notch (15*a*) when the drum (10) is turned and thereby locking the drum (10) in position. This locked and immobilized arrangement of the drum (10) allows the apparatus to be loaded or the drum (10) itself and its component parts to be adjusted to give the desired format.

What is claimed is:

1. A paper dispensing apparatus which is capable of adjustment based on the size and length of dispensed strip paper material, said apparatus comprising a housing, a cover, a drum disposed in a lower portion of said housing and supported for rotation therein, and a pivotally movable cutter device built into the drum and arranged longitudinally in a slot formed in the drum, said cutter device being pivotally movable based on the rotated position of said drum, wherein the drum comprises a hub defining in its center an annulus serving as the point of attachment and of adjustment of position of a cylinder part, in variable positions defining a variation of the format of the strip of paper material in terms of the length of the material, said cylinder part of the drum including first and second cylinder parts for variably defining the circumference of the drum and the variation of the size thereof, said first and second cylinder parts being lockable in position with respect to one another wherein the hub includes two interlocking parts each having at one end a disc plate, said disc plates being juxtaposed relative to one another to form said annulus, said first cylinder part being attached to said annulus and including a profiled piece capable of serving as the peripheral perimeter of the cylinder of the drum, wherein the remaining ends of each of the interlocking parts of the hub are engageable and fixed to sleeve forms which are fixed to end flanges capable of receiving the cutter device, said second cylinder part including a pair of plates hinged to the annulus of the hub, each said plate of said second cylinder part having cylindrical projecting supports onto which rings connected to each plate are mounted, said plates being able to come into partial contact with a ring part of the first cylinder part.

2. A dispensing apparatus according to claim 1, wherein one of the end flanges connected to the sleeve possesses an axial elongation on which is constructed a crank with a pin for attachment of a drum return and cocking spring, and in which the remaining oppositely situated end flange is constructed so as to permit, in particular, attachment of a blade holder of the cutter device.

3. A dispensing apparatus according to claim 1, wherein the first part of the cylinder part includes two identical sections arranged on either side of the annulus of the hub, each said identical section of said first cylinder part comprising a sleeve having a ring part situated around and adjacent to the annulus and extended radially inwards by lugs, wherein each of the disc plates defining the annulus of the hub are provided with curvilinear elongate slots, wherein the lugs are situated opposite said slots, said apparatus including connecting and fixing means for connecting and fixing them together.

4. A dispensing apparatus according to claim 3, wherein the ring parts of the first cylinder part are constructed about an angle of approximately 150 to 180°, and are extended by a curvilinear supporting surface defining a complementary support part of the cylinder for the strip of pulled paper material, said supporting surface being of a length at least equal to the end flanges of the drum mounted on the hub, the supporting surface being a half cylinder having slots, said surface ending near a longitudinal region from which the cutter device emerges from the drum, said slots formed along part of the length of the supporting surfaces providing a certain flexibility enabling the first cylinder part to deform elastically.

5. A dispensing apparatus according to claim 4, wherein the ring parts of the first cylinder part each include a plurality of recesses near a free end thereof, said recesses being formed partly at the end and partly along an outer peripheral edge.

6. A dispensing apparatus according to claim 1, wherein each said plate of said second cylinder part has a curvilinear profile including an inner region straddling said part and an adjacent raised region that can be in the same plane as the part of the cylinder in the rest condition, the inner region of each plate having a projection whose profile and form correspond to the recess indentations formed in the ring part of the first cylinder part.

7. A dispensing apparatus according to claim 6, wherein at least one return spring is attached by one end by an inwardly projecting lug formed on the ring part of the first cylinder part, the remaining end of said return spring being attached to the ring of the plate of the second cylinder part.

8. A dispensing apparatus according to claim 1, including a presser component resting on the drum between which passes the strip of pulled paper, wherein the variable-format drum further includes a paper guide having a pair of hinged parts, said paper guide being attached by clipping one of said hinged parts around a central part of said presser component.

9. A dispensing apparatus according to claim 1, including a guard for a cutter blade of the cutter device which is attached between side plates of the housing, said guard being mounted in a manner which permits elastic pivoting of said guard to cope with the rotation of the drum when differing formats of paper material are being cut.

10. A dispensing apparatus according to claim 1, further including a lock for immobilizing the drum when the cover is opened, either to load the apparatus or to modify the format of the strip of paper material to be cut.

11. A dispensing apparatus according to claim 10, wherein the lock includes a curved bar inserted between one of the side plates of the housing and an opposing face of the protective guard, said curved bar being hinged about a hinge pin of the guard and provided at an upper end with an inwardly projecting form that fits into a corresponding recess formed in the guard, and in which a lower end of the curved bar includes a projecting form protruding forwardly towards the cover, said curved bar further including an elastically deformable tongue having an end which can be placed against and rested on a stop piece formed on the side plate.

* * * * *